United States Patent [19]

Kauserud

[11] Patent Number: 4,576,215

[45] Date of Patent: Mar. 18, 1986

[54] METHOD FOR THE PRODUCTION OF FROZEN MOULD BODIES AND APPARATUS FOR USE IN THE CARRYING OUT OF THE METHOD

[75] Inventor: Håkon Kauserud, Ballerup, Denmark

[73] Assignee: Dansk Industri Syndikat A/S, Herlev, Denmark

[21] Appl. No.: 448,897

[22] PCT Filed: Apr. 7, 1982

[86] PCT No.: PCT/DK82/00027

§ 371 Date: Dec. 8, 1982

§ 102(e) Date: Dec. 8, 1982

[87] PCT Pub. No.: WO82/03580

PCT Pub. Date: Oct. 28, 1982

[30] Foreign Application Priority Data

Apr. 13, 1981 [DK] Denmark ..... 1663/81

[51] Int. Cl.[4] ..... B22C 9/00

[52] U.S. Cl. ..... 164/15; 164/7.1; 164/12

[58] Field of Search ..... 164/12, 7.1, 15, 16, 164/525, 528, 322, 323

[56] References Cited

U.S. PATENT DOCUMENTS

| | | | |
|---|---|---|---|
| 3,749,151 | 7/1973 | George et al. | 164/322 |
| 3,888,299 | 6/1975 | Bardet | 164/323 |
| 4,150,704 | 4/1979 | Hoult . | |

FOREIGN PATENT DOCUMENTS

| | | | |
|---|---|---|---|
| 0071037 | 6/1979 | Japan | 164/7.1 |
| 0152623 | 12/1979 | Japan | 164/525 |
| 0006754 | 1/1981 | Japan | 164/15 |
| 0047241 | 4/1981 | Japan | 164/7.1 |
| 0025245 | 2/1982 | Japan | 164/7.1 |
| 1537743 | 1/1979 | United Kingdom . | |

OTHER PUBLICATIONS

Patent Abstracts of Japan, abstract of JP 55-84250, publ. 06-25-1980.

Patent Abstracts of Japan, abstract of JP 56-6754, publ. 01-23-1981.

Patent Abstracts of Japan, abstract of JP 56-47240, publ. 04-28-1981.

Patent Abstracts of Japan, abstract of JP 56-47241, publ. 04-28-1981.

*Primary Examiner*—Nicholas P. Godici
*Assistant Examiner*—Kurt Rowan
*Attorney, Agent, or Firm*—Fleit, Jacobson, Cohn & Price

[57] ABSTRACT

In the production of frozen moulds (12) or cores the freezing process is accelerated by drawing the liquefied freezing agent, such as nitrogen, used for freezing the water in the mould bodies, into or through the bodies by the application of a vacuum.

8 Claims, 5 Drawing Figures

Figure 1:
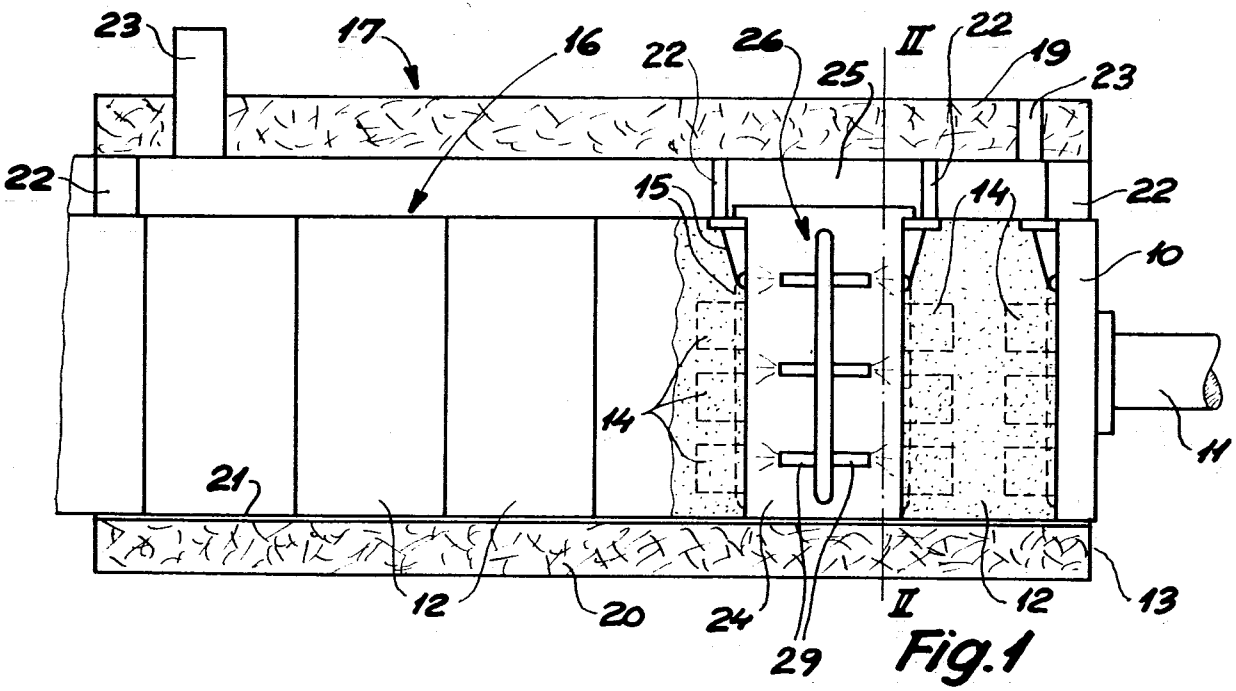

METHOD FOR THE PRODUCTION OF FROZEN MOULD BODIES AND APPARATUS FOR USE IN THE CARRYING OUT OF THE METHOD

The invention relates to a method of and apparatus for the production of frozen mould bodies which include granular material and a binder.

The use of a neutral binder, such as water, and a neutral coolant, such as liquefied nitrogen for freezing the water, totally obviates the environmental pollution which the use of conventional binders and catalysts has produced. It moreover reduces the manufacturing costs and allows the sand to be reused without subsequent treatment.

The known embodiments of the present method, by which the coolant is sprayed or poured into or on the mould body, suffer from the drawback that it takes a relatively long time to freeze the water to a sufficient depth; the object of the invention is to eliminate or significantly reduce this drawback.

The object is achieved in carrying out the method by drawing suction through a porous sand mass to increase significantly the rate at which the freezing agent can be caused to contact the binder in the mould body, resulting in a corresponding reduction in the time required for freezing and additional cooling to the necessary depth.

In an embodiment which provides for rapid penetration of the freezing agent into the mould bodies and which is used in connection with a mould string, the freezing medium is passed direct to the mould faces which later contact the molten metal.

The invention also concerns apparatus or a plant for use in the carrying out of the method, in which freezing is effected in the mould box.

The invention also concerns a mould production apparatus or plant in which the moulds are not frozen until they have left the mould box and have been pushed out on a mould path, and which includes a nozzle assembly mounted so that a vacuum tunnel can be closed by simple means simultaneously with the nozzle assembly being in its operative position between the exposed mould faces.

Figure 2:
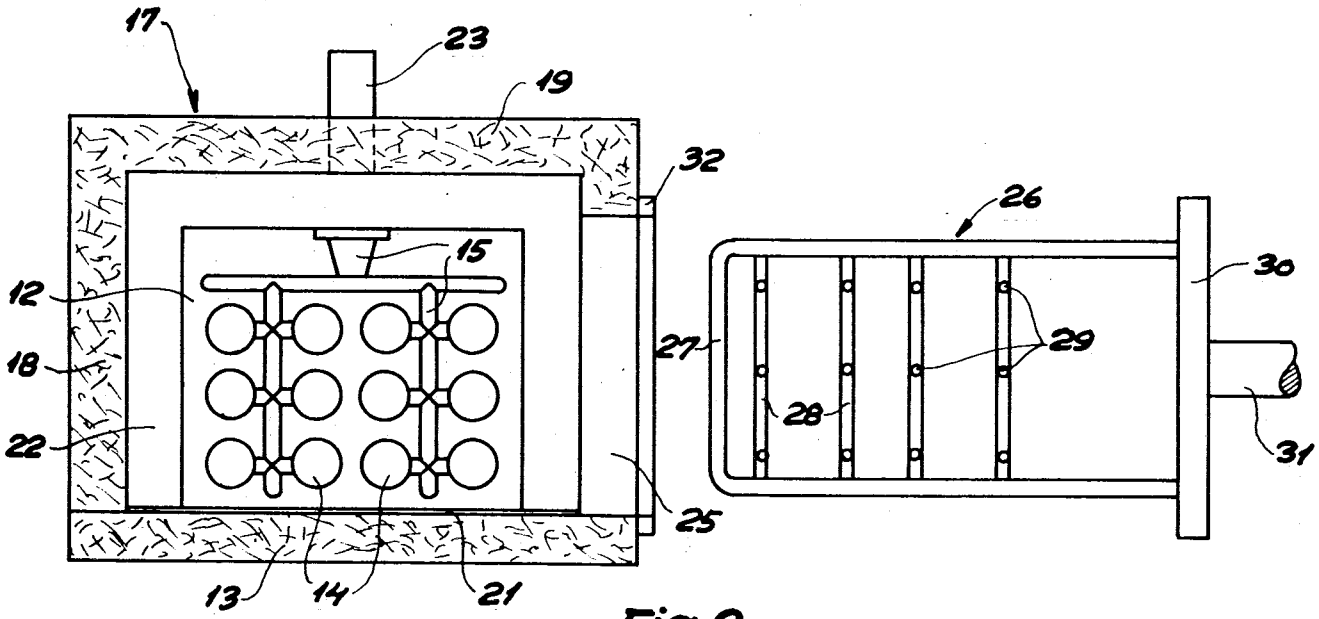
Figure 3:
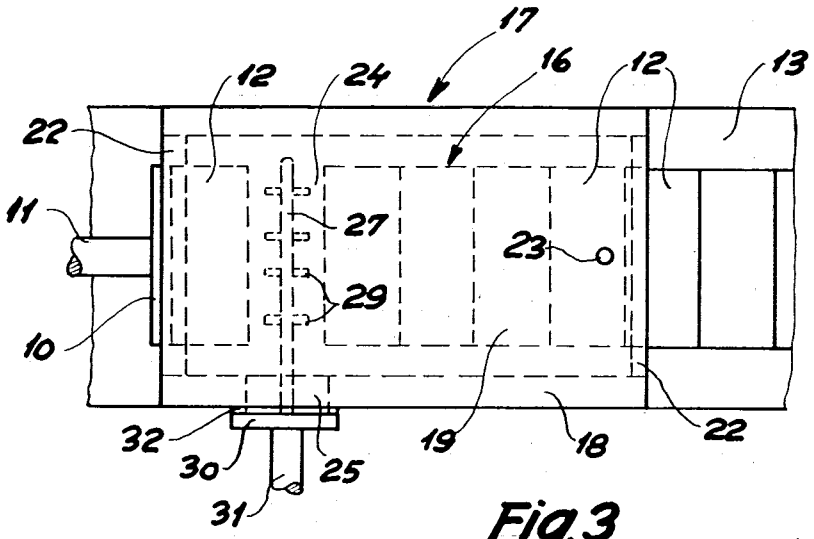

Embodiments of apparatus or plant in accordance with the invention will be described more fully below with reference to the drawing, in which:

FIG. 1 schematically shows an apparatus or a plant, in accordance with the invention as seen from the side and partly in section, with a nozzle assembly in its operative position, FIG. 2 is a cross-sectional view taken along the line II—II in FIG. 1, with the nozzle assembly in its inoperative position, FIG. 3 is a schematical top view of the plant of FIG. 1 on a reduced scale.

Figure 4:
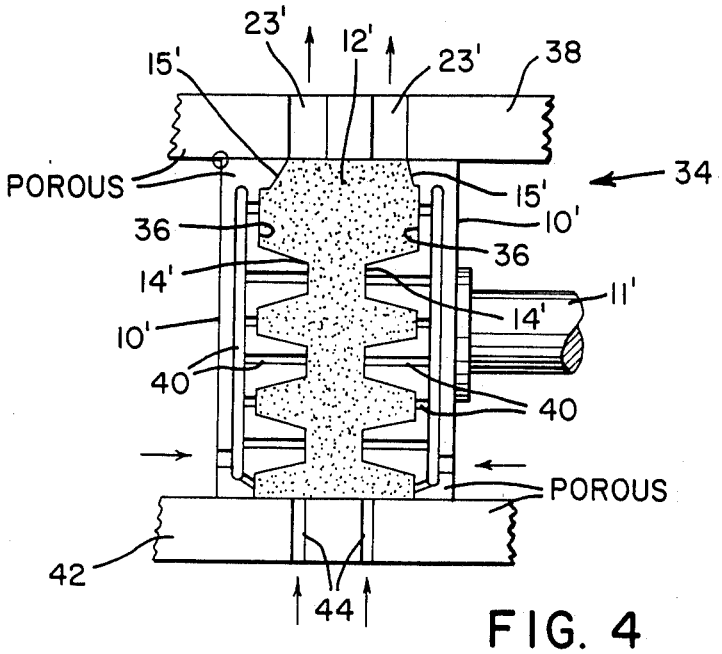
Figure 5:
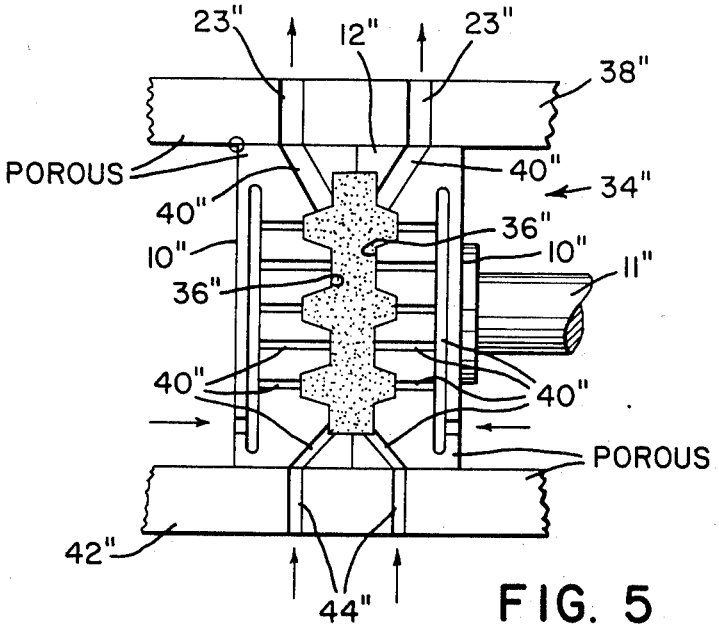

FIG. 4 is a schematical cross-sectional view of a moulding apparatus in accordance with another aspect of the invention, and FIG. 5 is a schematical cross-sectional view of another moulding apparatus in accordance with the aspect of the invention shown in FIG. 4.

In the drawing, 10 represents a pattern plate fitted on the piston rod 11 of a hydraulic cylinder (not shown) of a known moulding apparatus or mould producing machine, which moulds and presses each mould between two vertical pattern plates in a frame (not shown), and then one pattern plate is pivoted to a horizontal position and the other pushes the produced mould 12 out of the frame and forwardly to the position shown in FIGS. 1 and 3 on a mould path 13 by means of the hydraulic pressing cylinder. The pattern plates produce mould impressions 14 and impressions 15 which upon juxtapositioning of the moulds form mould cavities and ingates and sprues between each pair of adjacent moulds 12. The said position of the newly formed mould 12 provides a space 24 between this mould and the rear mould in the mould row 16 formed by the previously produced moulds on the mould path 13.

The rear end of the mould row 16 and the last-formed mould 12 are surrounded by a vacuum and cooling tunnel 17 defined by two side walls 18, a top wall 19 and a bottom 20 of heat insulating material. The bottom 20 constitutes a part of the mould path 13 and supports a slide plate 21 on which the moulds 12 can rest and slide. Gaskets 22 are provided at the ends of the tunnel 17, and they extend from the side walls 18 and the top wall 19 towards and resiliently and sealingly engage the mould row 16 and edge faces of the pattern plate 10, respectively, in the pattern plate position shown in FIGS. 1 and 3. Additional gaskets 22 (FIG. 1) are provided on opposite sides of the space 24. Adjacent the front end of the tunnel 17 a through pipe stub 23, which can be connected to a source of vacuum (not shown), is fitted in the top wall 19. Similarly, at the rear end of the tunnel 17, a vacuum hole, also designated by the numeral 23 (FIG. 1), is formed in the top wall 19.

Opposite the space 24 between the last-formed mould 12 and the rear end of the mould row 16 one tunnel side wall 18 is formed with an opening 25 through which a freezing agent applying device in the form of a nozzle assembly generally designated by 26 can be inserted into the space 24. The nozzle assembly 26 is formed by a U-shaped frame 27, between the legs of which there extends a plurality of vertical pipes 28, which each carry a plurality of nozzle pipes 29 disposed end to end in pairs and extending in parallel with the mould path; in the active position of the nozzle assembly shown in FIGS. 1 and 3 one half of the nozzle pipes 29 are rearwardly directed towards the mould face of the last-formed mould 12, the other half being forwardly directed towards the exposed mould face of the rear mould in the mould row 16.

The nozzle assembly 26 is secured to and extends perpendicularly from a closing plate 30 placed at the end of the piston rod 31 in a hydraulic cylinder (not shown), which is capable of reciprocating it between the position shown in FIG. 2, in which the entire nozzle assembly is disposed outside the vacuum and cooling tunnel 17, and the position shown in FIGS. 1 and 3 with the nozzle assembly disposed in the space 24 between the moulds. In the second position the edge portions of the closing plate sealingly engage a gasket 32 fitted circumferentially in the edge of the opening 25 in the side wall of the tunnel 17.

The nozzle assembly 26 is connected to a source of a liquefied freezing agent, e.g. nitrogen, by means (not shown) comprising a non-return valve. In the active position of the nozzle assembly 26 the freezing agent is sprayed on the two mould faces directed towards the nozzle assembly, and the vacuum simultaneously applied on the outer faces of the moulds present in the vacuum and cooling tunnel 17 causes the freezing agent to be drawn rapidly into the moulding sand and to cool the water in the sand below the freezing point, so that the water will turn into ice which binds the sand grains together. After this freezing process the supply of coolant to the nozzle assembly 26 is interrupted, and the nozzle assembly is withdrawn from the tunnel 17 to the position shown in FIG. 2. The drive cylinder for the pattern plate 10 then pushes the last-formed mould 12 into engagement with the mould row 16 and additionally pushes the entire mould row a distance forwards corresponding to the thickness of a mould. This mould row movement can be supported by a generally known advancing mechanism (not shown). After the completion of the advancing movement the pattern plate 10 returns to its operative position in which it can cooperate with the other pattern plate (not shown) to produce a new mould.

Owing to considerations of space it may be expedient in practice to mount the moving cylinder (not shown) for the closing plate 30 and the nozzle assembly 26 above the tunnel 17 instead of at its side, as indicated in FIG. 2. The shown and described plant can also be modified in many other ways.

Plants according to the invention may assume many other shapes than the one shown and described in the foregoing. It may e.g. be formed by a closed, heat insulated box in which one or more sand moulds or cores may be placed and which may be evacuated and then be supplied with liquefied coolant, which because of the evacuation penetrates rapidly into the mould bodies and freezes at least part of the water in it.

This effect will be greatly enhanced when the mould bodies are formed by a string of juxtaposed moulds like the one shown in FIGS. 1 and 3 and the means for supplying freezing agent are adapted to supply this agent direct to the ingates 15 of the moulds.

FIG. 4 schematically shows moulding apparatus in the form of a mould box 34 of the type described above with reference to FIGS. 1–3, which has been modified in accordance with the invention for forming a frozen mould body 12', having cavity and ingate-forming impressions 14' and 15', in a mould cavity 36. As modified, the mould box 34 has an upper wall 38 which may be of porous material and/or formed with small vacuum holes or channels 23'. Opposite walls of the mould box 34 are formed by a first vertical pattern plate 10' mounted on a piston rod 11' and a pivoted second vertical pattern plate 10'. The pattern plates 10' also may be of porous material and/or formed with small holes or channels 40. Further, a lower wall 42 may be of porous material or formed with small holes or channels 44. In use, a freezing agent is pressed or sprayed through the pattern plates 10' and the lower wall 42, and a vacuum is applied to the mould box upper wall 38 to draw the freezing agent through or into the mould body 12' in the mould cavity 36 during or immediately after the formation thereof.

FIG. 5 schematically shows moulding apparatus in the form of a two-part core box 34'' for forming a frozen core body 12''. The core box 34'' is of the same general construction as the mould box 34 in FIG. 4, with like parts being identified by the same reference numerals. Thus, the core box 34'' includes vertical opposed core-forming parts 10'' generally corresponding to the pattern plates 10' of the mould box 34 in FIG. 4, and which define a mould cavity 36''. The core-forming parts 10'' may be of porous material and/or formed with small holes or channels 40''. Similarly, upper and lower walls 38'' and 42'' may be of porous material and/or formed with small holes or channels 23'' and 44'', respectively. In use, a freezing agent is introduced into the mould cavity 36'' by pressing or spraying the freezing agent through the core-forming parts 10'' and the lower wall 42'' while a vacuum is applied to the upper wall 38'' to draw the freezing agent through or into the hollow core body 12'' during or immediately after the formation thereof.

I claim:

1. A method of producing a frozen mould body which includes granular material and a binder, which comprises the steps of:

forming the mould body of the granular material and the binder in a moulding apparatus which defines a mould cavity and which includes a plurality of separate mould parts, a first one of the mould parts being in the form of a movable pattern plate for forming impressions in the adjacent face of the mould body;

introducing a freezing agent into the mould cavity through the movable pattern plate; and simultaneously applying a vacuum to at least part of an outer wall portion of a second mould part to draw the freezing agent into the mould body in the mould cavity so as to freeze the binder in the mould body.

2. The method as recited in claim 1, in which:

at least one of the first and second mould parts is of porous material.

3. The method as recited in claim 1, in which:

the movable pattern plate is of porous material.

4. The method as recited in claim 1, in which:

the freezing agent is introduced through the pattern plate via holes in the pattern plate.

5. The method as recited in claim 1, in which:

the mould body is formed in a core box as a core member and the movable pattern part, through which freezing agent is introduced into the mould cavity, is a core-forming part.

6. The method as recited in claim 5, in which:

at least one of the mould parts is of porous material.

7. The method as recited in claim 5, in which:

the freezing agent is introduced through the core-forming part via holes in the core-forming part.

8. The method as recited in claim 1, which further comprises:

forming ingates in the mould body during the forming of the mould body;

arranging a plurality of mould bodies in a string of juxtaposed mould bodies; and introducing a freezing agent into the mould bodies through the ingates.

* * * * *